US007988350B2

(12) United States Patent
Bonnet et al.

(10) Patent No.: US 7,988,350 B2
(45) Date of Patent: Aug. 2, 2011

(54) WATCH CASE WITH A COMPOSITE MIDDLE PART

(75) Inventors: Pierre-Jean Bonnet, Courtelary (CH); Jean-Claude Monachon, Les Vieux-Prés (CH)

(73) Assignee: Omega S.A., Bienne (CH)

( * ) Notice: Subject to any disclaimer, the term of this patent is extended or adjusted under 35 U.S.C. 154(b) by 70 days.

(21) Appl. No.: 12/443,430

(22) PCT Filed: Sep. 5, 2007

(86) PCT No.: PCT/CH2007/000439

§ 371 (c)(1),
(2), (4) Date: Mar. 27, 2009

(87) PCT Pub. No.: WO2008/037097

PCT Pub. Date: Apr. 3, 2008

(65) Prior Publication Data

US 2009/0245032 A1 Oct. 1, 2009

(30) Foreign Application Priority Data

Sep. 27, 2006 (EP) ..... 06020199

(51) Int. Cl.
*G04B 37/00* (2006.01)

(52) U.S. Cl. ..... 368/297; 368/280; 368/310

(58) Field of Classification Search ..... 368/276–298, 368/309–310

See application file for complete search history.

(56) References Cited

U.S. PATENT DOCUMENTS

| | | | | | |
|---|---|---|---|---|---|
| 221,155 | A | * | 11/1879 | Colby et al. | 368/280 |
| 309,158 | A | * | 12/1884 | O'Hara | 368/299 |
| 320,127 | A | * | 6/1885 | Giles | 368/310 |
| 372,558 | A | * | 11/1887 | Morrill | 368/310 |
| 969,680 | A | * | 9/1910 | Worrell | 368/291 |
| 1,321,867 | A | * | 11/1919 | Wadsworth | 368/297 |
| 3,492,810 | A | * | 2/1970 | Levrat | 368/287 |
| 3,643,424 | A | * | 2/1972 | Simon | 368/291 |
| 3,828,549 | A | * | 8/1974 | Nozawa et al. | 368/291 |
| RE28,527 | E | * | 8/1975 | Kushida | 368/280 |
| 3,992,870 | A | * | 11/1976 | Dekel | 368/204 |
| 4,064,688 | A | * | 12/1977 | Sasaki et al. | 368/69 |
| 4,421,423 | A | * | 12/1983 | Lederrey | 368/291 |
| 4,522,508 | A | * | 6/1985 | Meister | 368/276 |

(Continued)

FOREIGN PATENT DOCUMENTS

CH 517963 1/1965

(Continued)

OTHER PUBLICATIONS

International Search Report issued in corresponding application No. PCT/CH2007/000439, completed Mar. 13, 2008 and mailed Apr. 4, 2008.

(Continued)

*Primary Examiner* — Sean Kayes
(74) *Attorney, Agent, or Firm* — Griffin & Szipl, P.C.

(57) ABSTRACT

The middle part includes an inner metallic middle part (10) and an outer middle part (20) made of a natural or synthetic mineral material, such as ceramics. The inner middle part (10) is itself made up of a top ring (12) and a bottom ring (14), each ring including a radial, peripheral extension (13, 15), whose opposite shoulders can mechanically lock the outer middle part (20), for example by screwing the two rings (12, 14) one inside the other.

20 Claims, 2 Drawing Sheets

U.S. PATENT DOCUMENTS

| | | | | | |
|---|---|---|---|---|---|
| 4,545,688 | A | * | 10/1985 | Ray et al. | 368/291 |
| 4,548,514 | A | * | 10/1985 | Ganter | 368/291 |
| 4,620,798 | A | | 11/1986 | Scarinzi | |
| 4,626,108 | A | * | 12/1986 | Ganter | 368/291 |
| 4,853,910 | A | | 8/1989 | Mock | |
| 4,967,402 | A | | 10/1990 | Georges | |
| 4,979,157 | A | * | 12/1990 | Gogniat | 368/276 |
| 5,521,889 | A | * | 5/1996 | Scarinzi et al. | 368/294 |
| 6,411,569 | B1 | * | 6/2002 | Megner et al. | 368/43 |
| 6,863,436 | B2 | * | 3/2005 | Kaelin | 368/298 |
| 7,281,845 | B2 | * | 10/2007 | Hohenstein et al. | 368/281 |
| 7,540,655 | B2 | * | 6/2009 | Speichinger | 368/190 |
| 2002/0131332 | A1 | | 9/2002 | Kaelin et al. | |

FOREIGN PATENT DOCUMENTS

| | | |
|---|---|---|
| CH | 640 995 | 2/1984 |
| EP | 0 327 829 | 8/1989 |
| EP | 1 321 833 | 6/2003 |

OTHER PUBLICATIONS

Random House Webster's College Dictionary, pp. 147, 1035 and 1036 (1991).

* cited by examiner

WATCH CASE WITH A COMPOSITE MIDDLE PART

This is a National Phase Application in the United States of International Patent Application No. PCT/CH2007/000439 filed Sep. 5, 2007, which claims priority on European Patent Application No. 06020199.3, filed Sep. 27, 2006. The entire disclosures of the above patent applications are hereby incorporated by reference.

FIELD OF THE INVENTION

The present invention concerns a watchcase with a composite middle part including an outer part and an inner part. The outer part is made of a hard mineral material chosen both to provide protection against external attack, such as corrosion, friction or scratches, and to contribute to the general attractiveness of the watch. The inner part is made of an easily machinable material and enables all the other components to be assembled to the watch.

BACKGROUND OF THE INVENTION

Timepieces whose case includes a middle part made of a hard, natural or synthetic mineral such as sapphire, ceramics or a natural or reconstituted jewel, are already known. Such materials do not withstand mechanical stress very well and efforts have therefore been made to reduce machining operations as far as possible or to limit them to machining a housing for a timepiece movement and through passages for the control member stems.

CH Patent No. 517 963 discloses, in accordance with one embodiment, a bezel-middle part type exterior made from a metal carbide based material with a hardness close to that of topaz, while emphasising that it would be very difficult to form threadings in this material for assembling all the other watch components. The same difficulties would be encountered if the material used were topaz or any other natural or synthetic mineral material. In order to overcome this problem of assembling components, it was then proposed to use an inner metallic middle part onto which the bezel-middle part is fitted, while compensating for any variation in dimensions by adhesive bonding and while ensuring water-resistance.

U.S. Pat. No. 4,620,798 also discloses a construction that includes an inner middle part and an outer middle part. The inner metallic middle part both secures a back cover via screws and a bezel via adhesive bonding, which also includes a glued joint for securing the crystal. The back cover and the bezel extend slightly radially beyond the inner middle part and hold the outer middle part, which is made of a natural or synthetic mineral material, in place.

A construction of the preceding type is also disclosed in U.S. Pat. No. 4,853,910, wherein a single part, which forms at the same time the dial, bezel and middle part, made of a hard mineral material, is assembled to an inner metallic middle part by bonding.

As can be seen from the aforecited prior art, adhesive bonding, in one way or another, appears to be an inescapable step for assembling an outer middle part made of a mineral or synthetic material and an inner metallic middle part.

The technique of adhesive bonding has, however, well known drawbacks. The first is the choice of a suitable adhesive for two different materials, such as a metal and a ceramic material. The second is linked to the aging of the adhesive, which can lead to a loss of adhesion, or to cracks that over time can lessen the water-resistance of the case. These drawbacks are not acceptable for medium or top of the range timepieces, which should have a long lifetime.

SUMMARY OF THE INVENTION

It is thus an object of the present invention to overcome the drawbacks of the aforecited prior art by providing a case that has an outer middle part made of natural or synthetic mineral material, such as ceramics, which is assembled without being subjected to mechanical stress.

The invention therefore concerns a watch case with a composite middle part formed by two essential parts, one forming the outer middle part made of a mineral material, and the other forming the inner middle part made of a metal that can easily be machined to enable all the other watch components to be assembled. The invention is characterized in that the inner middle part is itself made in two parts, formed by two rings, designed and mechanically assembled to each other so that they can lock the outer middle part with a slight play.

Each ring includes a radial peripheral extension whose opposite shoulders can lock the outer middle part, for example by screwing the two rings, one inside the other. The only machining of the outer middle part, which is made of a hard mineral material sensitive to mechanical stress, concerns the through passages for the control members. These through passages can be made with slight play given that the mechanical assembly is transferred to the inner metallic middle part.

More particularly, in accordance with a first embodiment of the present invention, a watch case is provided that includes a composite middle part (1) through which pass the stems of the control members (3, 5*a*, 5*b*), a back cover (6) and a bezel (7) closed by a crystal (8) together delimiting a space which houses a timepiece movement (4) for displaying time data or non-time related data on a dial (9), wherein the middle part (1) is formed of an inner metallic middle part (10) and an outer middle part (20) made of a natural or synthetic mineral material, characterized in that the inner middle part (10) is formed of a top ring (12) assembled to a bottom ring (14), wherein the top ring (12) includes an axial extension (16) which abuts on a peripheral shoulder (18) of the bottom ring (14), and in that the two rings (12, 14) each have a radial extension (13, 15) oriented towards the exterior for blocking the outer middle part (20) with slight play by mechanically assembling the two rings (12, 14) to each other. In accordance with a second embodiment of the present invention, the first embodiment is modified so that the two rings (12, 14) are assembled using screws. In accordance with a third embodiment of the present invention, the first embodiment is modified so that a sleeve (17) is housed in a recess (19) of one of the rings (12, 14) of the inner middle part (10) to provide a slight play between the inner and outer middle parts (10, 20) and to allow the outer middle part (20) to be centred radially.

In accordance with a fourth embodiment of the present invention, the first embodiment is modified so that the top ring (12) is arranged to allow assembly of the crystal (8), the bezel (7) and the dial (9). In accordance with a fifth embodiment of the present invention, the first embodiment is modified so that the radial extension (13) of the top ring (12) is provided with a recess (22) for housing a sealing gasket (23) ensuring water-resistance between the top ring (12) and the bottom ring (14). In accordance with a sixth embodiment of the present invention, the first embodiment is modified so that the bottom ring (14) is arranged to allow assembly of the back cover (6) and the timepiece movement (4). In accordance with a seventh embodiment of the present invention, the first embodiment is modified so that the base of the bottom ring (14) includes a recess (24) for housing a sealing gasket (25) between the back cover (6) and the bottom ring (14).

In accordance with an eighth embodiment of the present invention, the first embodiment is modified so that the inner middle part (10) and the outer middle part (20) include through passages (26, 28) opposite the stems of the control members (3, 5*a*, 5*b*). In accordance with a ninth embodiment of the present invention, the eighth embodiment is further modified so that the through passage (28) of the outer middle part (20), has a semi-circular shape, open towards the bottom of the case and in that the through passage (26) of the inner middle part (10) includes a collar (27) that engages in the through passage (28) of the outer middle part (20). In accordance with a tenth embodiment of the present invention, the first embodiment is modified so that the material of the outer middle part (20) is selected from among ceramics, sapphire and natural or artificial jewels.

BRIEF DESCRIPTION OF THE DRAWINGS

Other features and advantages of the invention will appear more clearly in the following description of an example embodiment, given by way of non-limiting illustration, with reference to the annexed drawings, in which.

DETAILED DESCRIPTION OF THE INVENTION

Figure 1:
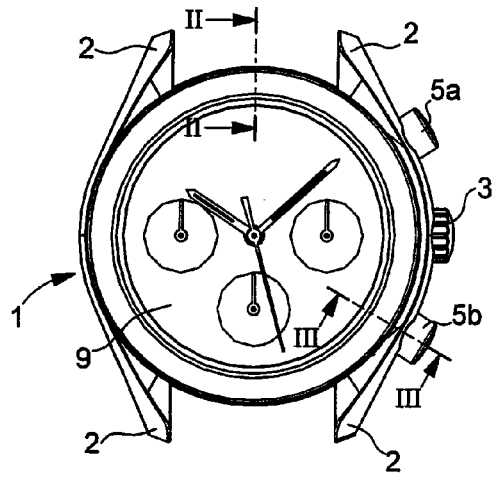
FIG. 1 shows a top view of a chronograph watch housed in a case according to the invention.

FIG. 1 shows, by way of example, a chronograph watch including, in a known manner, a winding/time-setting stem 3 and two push buttons 5*a* and 5*b* whose stems, which control the timepiece movement 4, necessarily pass through the middle part 1, which is provided with horns 2 for securing bracelet or wristband strands. The current time and timing data using counters, is displayed in a conventional manner on a dial 9. It is clear that the concept of an outer middle part made of a natural or synthetic mineral material, which will be described hereafter, can also equally be applied to a watch that simply has one crown, or to a timepiece that, conversely, has a larger number of push-buttons.

Figure 2:
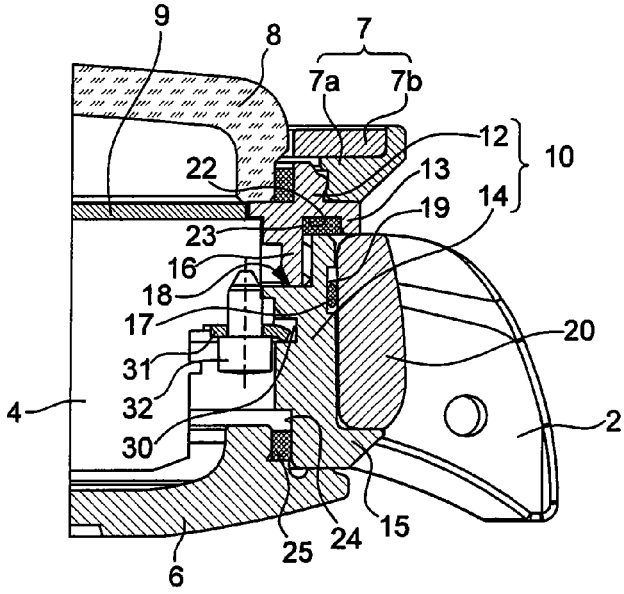
FIG. 2 is a partial cross-section at 12 o'clock along line II-II of FIG. 1.
Figure 3:
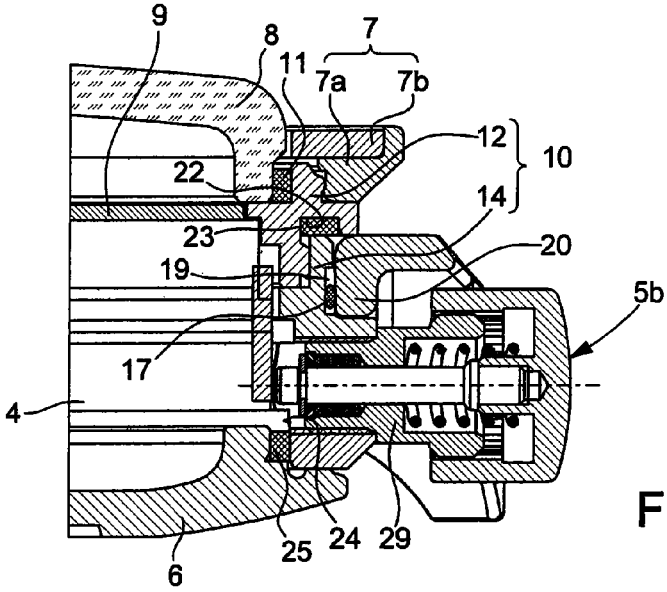
FIG. 3 is a partial cross-section through a push-button along line III-III of FIG. 1.
Figure 4:
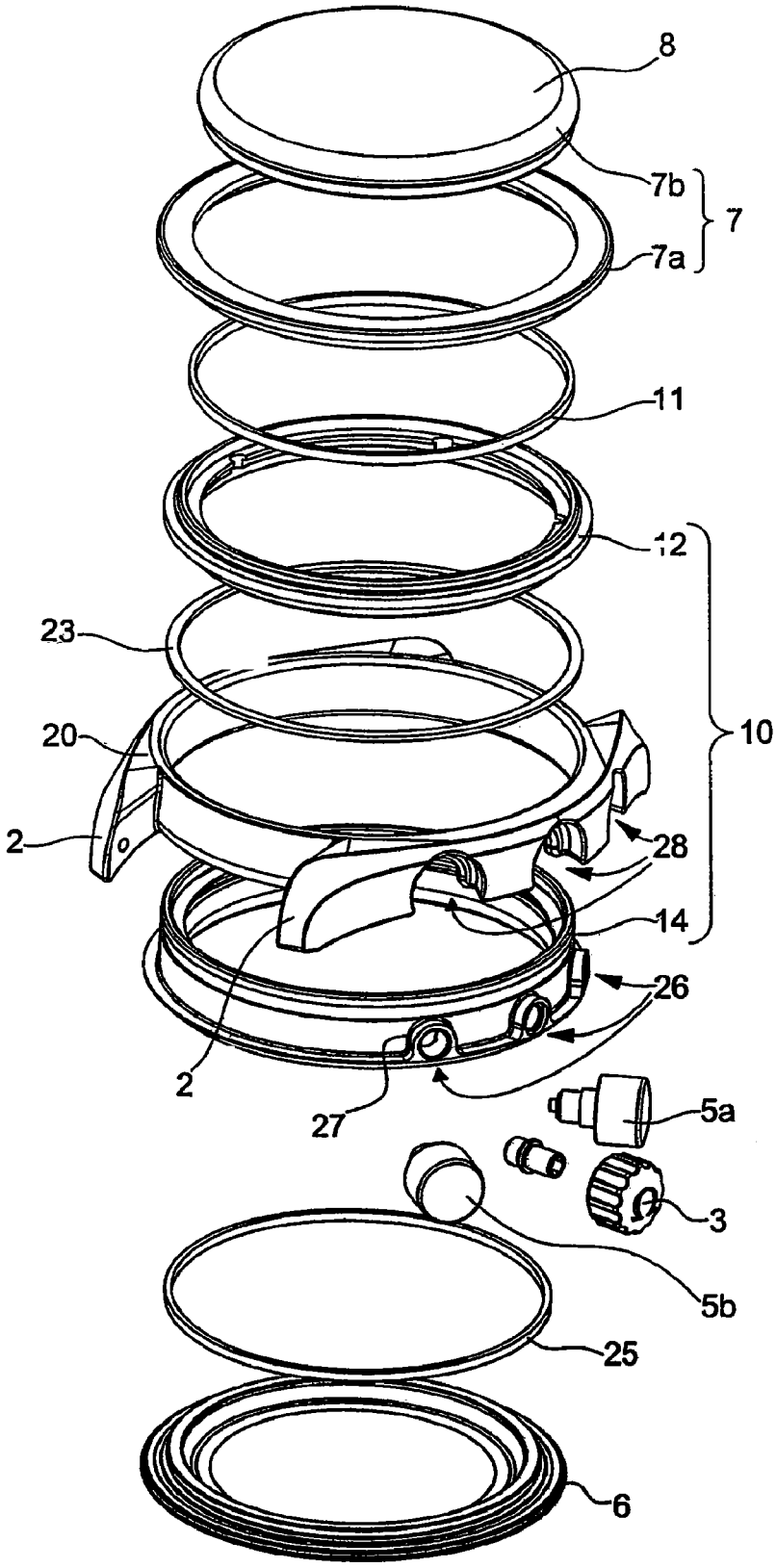
FIG. 4 is an exploded perspective view of the case corresponding to the chronograph watch of FIG. 1.

Referring now to FIGS. 2, 3 and 4, we will explain below how a construction according to the invention can provide a case with an outer middle part 20, for example made of ceramic material, on which no mechanical stress is exerted, and which does not require any adhesive joints in order to be assembled.

The outer middle part 20 is, in a way, sandwiched by an inner metallic middle part 10, for example made of steel or brass. The inner middle part is made in two parts, formed by a top ring 12 and a bottom ring 14, with the two rings 12, 14, being mechanically assembled to each other. In the example shown, this mechanical assembly is achieved by screwing the top ring 12 into the inner wall of the bottom ring 14. It is clear that the top ring could equally well be screwed into the outer wall of bottom ring 14.

Top ring 12 includes a radial peripheral extension 13 that extends beyond the wall of bottom ring 14. It also includes an annular axial extension 16 that abuts against a corresponding shoulder 18 of bottom ring 14. Opposite the ring formed by shoulder 18, top ring 12 includes a groove 22 for placing a sealing gasket 23 between the two rings 12, 14.

Top ring 12 is also arranged for securing a bezel 7, which is made in two parts 7*a*, 7*b* in this example, a crystal 8 and a dial 9. The bezel 7 is secured to top ring 12, while ring 7*a* can, for example, vary the aesthetic appearance of a given model, or be used for adding inscriptions.

Bottom ring 14 also includes a peripheral extension 15 that extends at approximately the same distance as extension 13 from top ring 12. As can easily be understood from the exploded perspective view of FIG. 4, it is very simple to assemble outer middle part 20: outer middle part 20 is fitted onto bottom ring 14, then top ring 12 is screwed in until the axial extension 16 thereof abuts on shoulder 18 of the bottom ring, with the radial extensions 13, 15 of rings 12, 14 then pressing on the top and bottom edges of outer middle part 20. So that no mechanical stress is exerted on the ceramic material of outer middle part 20, the distance between the opposite shoulders of extensions 13 and 15 must be very slightly greater than the height of outer middle part 20. For the same reason, some play is also provided between the outer wall of inner middle part 10 and the inner wall of outer middle part 20. Moreover, the outer wall of bottom ring 14 includes an annular groove 19, which houses a sleeve 17 for centring outer middle part 20 in a radial direction.

Like top ring 12, bottom ring 14 is arranged for assembling other watch components, such as back cover 6 and timepiece movement 4. In the example shown, the base of bottom ring 14 includes an annular recess 24 for housing a sealing gasket 25 between the ring 14 and clicked-on back cover 6. It is clear that any other means known to those skilled in the art for assembling the back cover are possible, such as using screws. To secure movement 4, as shown in FIG. 2, one could use a known technique in this field by making a countersink 30 in the inner wall of bottom ring 14, in which a flange 31 is engaged and secured by a screw 32.

Referring now to FIG. 3, which shows a cross-section of a push-button 5*b*, and to FIG. 4, we will explain below how the invention enables the stems of control members 3, 5*a* and 5*b* to pass, without exerting mechanical stress on outer middle part 20. Bottom ring 14 is provided with through passages 26, arranged opposite through passages 28 of outer middle part 20. In the preferred embodiment shown, it can be seen that through passages 28 have the shape of a semi-circle that is open towards the bottom and through passages 26 each include a collar 27 that can engage in through passages 28 and enable the univocal angular orientation of outer middle part 20. Through passages 26 include a threading that enables bush 29, which includes a push-button mechanism that will not be described here as it is well known to those skilled in the art, to be screwed in. The same is true for the other push-button and for the winding stem.

In the example that has just been described, it may be noted that the bottom ring 14 is the most important and plays a "dominant" part. It is clear that the roles could be reversed, without departing from the scope of the invention: top ring 12 could have the dominant role by making necessary adaptations, which are within the grasp of those skilled in the art.

Likewise, the example described concerns a circular case, but the invention is not limited to this shape. The case could have an oval or rectangular shape. The only adaptation to be made consists in altering the mechanical assembly of rings 12, 14, for example by using a click-on type device, which would have the advantage of making the case completely impossible to dismantle. The click-on technique could of course be used for a circular case.

Likewise for a circular case, rings 12, 14 could be assembled using a bayonet device.

Those skilled in the art could envisage other variants and adaptations without departing from the scope of the present invention.

The invention claimed is:

1. A watch case including:

(a) a composite middle part through which pass stems of control members of a watch;

(b) a back cover and a bezel closed by a crystal, wherein the back cover, the bezel and the crystal together define a space that houses a timepiece movement for displaying time data or non-time related data on a dial of the watch, wherein the composite middle part comprises i. an inner metallic middle part; and ii. an outer middle part made of a natural or synthetic mineral material, wherein the inner middle part comprises a top ring assembled to a bottom ring, wherein the top ring includes an axial extension that abuts on a peripheral shoulder of the bottom ring, and wherein the top ring and the bottom ring each have a radial extension oriented towards an exterior in order to block movement of the outer middle part with slight play by mechanically assembling the top ring and the bottom ring to each other, wherein the outer middle part is sandwiched between the radial extension of the top ring and the radial extension of the bottom ring, and wherein the bottom ring is arranged to allow assembly of the back cover and the timepiece movement.

2. The watch case according to claim 1, wherein the top ring and the bottom ring are assembled to each other using screws.

3. The watch case according to claim 1, wherein the top ring is arranged to allow assembly of the crystal and the bezel of the watch case with the dial of the watch.

4. The watch case according to claim 1, wherein the radial extension of the top ring is provided with a recess that houses a sealing gasket that is disposed to ensure water-resistance between the top ring and the bottom ring.

5. The watch case according to claim 1, wherein a base of the bottom ring includes a recess formed therein, wherein the recess formed in the base of the bottom ring houses a sealing gasket disposed between the back cover and the bottom ring.

6. The watch case according to claim 1, wherein the inner middle part and the outer middle part of the watch case include through passages opposite the stems of the control members of the watch.

7. The watch case according to claim 1, wherein the material of the outer middle part is selected from among the group consisting of ceramics, sapphire, natural jewels and artificial jewels.

8. A watch comprising a watch case, wherein the watch case includes:

(a) a composite middle part through which pass stems of control members of the watch;

(b) a back cover and a bezel closed by a crystal, wherein the back cover, the bezel and the crystal together define a space that houses a timepiece movement for displaying time data or non-time related data on a dial of the watch, wherein the composite middle part comprises i. an inner metallic middle part; and ii. an outer middle part made of a natural or synthetic mineral material, wherein the inner middle part comprises a top ring assembled to a bottom ring, wherein the top ring includes an axial extension that abuts on a peripheral shoulder of the bottom ring, and wherein the top ring and the bottom ring each have a radial extension oriented towards an exterior in order to block movement of the outer middle part with slight play by mechanically assembling the top ring and the bottom ring to each other, wherein the outer middle part is sandwiched between the radial extension of the top ring and the radial extension of the bottom ring, and wherein the bottom ring is arranged to allow assembly of the back cover and the timepiece movement.

9. The watch according to claim 8, wherein the top ring and the bottom ring are assembled to each other using screws.

10. The watch according to claim 8, wherein the top ring is arranged to allow assembly of the crystal and the bezel of the watch case with the dial of the watch.

11. The watch according to claim 8, wherein the radial extension of the top ring is provided with a recess that houses a sealing gasket that is disposed to ensure water-resistance between the top ring and the bottom ring.

12. The watch according to claim 8, wherein a base of the bottom ring includes a recess formed therein, wherein the recess formed in the base of the bottom ring houses a sealing gasket disposed between the back cover and the bottom ring.

13. The watch according to claim 8, wherein the inner middle part and the outer middle part of the watch case include through passages opposite the stems of the control members of the watch.

14. The watch according to claim 8, wherein the material of the outer middle part is selected from among the group consisting of ceramics, sapphire, natural jewels and artificial jewels.

15. A watch case including:

(a) a composite middle part through which pass stems of control members of a watch;

(b) a back cover and a bezel closed by a crystal, wherein the back cover, the bezel and the crystal together define a space that houses a timepiece movement for displaying time data or non-time related data on a dial of the watch, wherein the composite middle part comprises i. an inner metallic middle part; and ii. an outer middle part made of a natural or synthetic mineral material, wherein the inner middle part comprises a top ring assembled to a bottom ring, wherein the top ring includes an axial extension that abuts on a peripheral shoulder of the bottom ring, and wherein the top ring and the bottom ring each have a radial extension oriented towards an exterior in order to block the outer middle part with slight play by mechanically assembling the top ring and the bottom ring to each other, wherein the bottom ring is arranged to allow assembly of the back cover and the timepiece movement, wherein the inner middle part and the outer middle part of the watch case include through passages opposite the stems of the control members of the watch, and the through passages of the outer middle part have a semi-circular shape, and open towards a bottom of the watch case, and wherein each through passage of the inner middle part includes a collar that engages in a corresponding through passage of the outer middle part.

16. A watch comprising a watch case, wherein the watch case includes:

(a) a composite middle part through which pass stems of control members of the watch;

(b) a back cover and a bezel closed by a crystal, wherein the back cover, the bezel and the crystal together define a space that houses a timepiece movement for displaying time data or non-time related data on a dial of the watch, wherein the composite middle part comprises i. an inner metallic middle part; and ii. an outer middle part made of a natural or synthetic mineral material, wherein the inner middle part comprises a top ring assembled to a bottom ring, wherein the top ring includes an axial extension that abuts on a peripheral shoulder of the bottom ring, and wherein the top ring and the bottom ring each have a radial extension oriented towards an exterior in order to block the outer middle part with slight play by mechanically assembling the top ring and the bottom ring to each other, wherein the bottom ring is arranged to allow assembly of the back cover and the timepiece movement, wherein the inner middle part and the outer middle part of the watch case include through passages opposite the stems of the control members of the watch, and the through passages of the outer middle part have a semi-circular shape, and open towards a bottom of the watch case, and wherein each through passage of the inner middle part includes a collar that engages in a corresponding through passage of the outer middle part.

17. A watch case including:

(a) a composite middle part through which pass stems of control members of a watch;

(b) a back cover and a bezel closed by a crystal, wherein the back cover, the bezel and the crystal together define a space that houses a timepiece movement for displaying time data or non-time related data on a dial of the watch, wherein the composite middle part comprises i. an inner metallic middle part; and ii. an outer middle part made of a natural or synthetic mineral material, wherein the inner middle part comprises a top ring assembled to a bottom ring, wherein the top ring includes an axial extension that abuts on a peripheral shoulder of the bottom ring, and wherein the top ring and the bottom ring each have a radial extension oriented towards an exterior in order to block movement of the outer middle part with slight play by mechanically assembling the top ring and the bottom ring to each other, wherein the outer middle part is sandwiched between the radial extension of the top ring and the radial extension of the bottom ring, and wherein the bottom ring is arranged to allow assembly of the back cover and the timepiece movement, wherein a sleeve is housed in a recess that is formed in the bottom ring of the inner middle part, wherein the sleeve housed in the recess provides a slight play between the inner middle part and the outer middle part and allows the outer middle part to be centered radially with respect to the inner middle part.

18. The watch according to claim 17, wherein the sleeve housed in the recess provides a slight radial play between the inner middle part and the outer middle part.

19. A watch comprising a watch case, wherein the watch case includes:

(a) a composite middle part through which pass stems of control members of the watch;

(b) a back cover and a bezel closed by a crystal, wherein the back cover, the bezel and the crystal together define a space that houses a timepiece movement for displaying time data or non-time related data on a dial of the watch, wherein the composite middle part comprises i. an inner metallic middle part; and ii. an outer middle part made of a natural or synthetic mineral material, wherein the inner middle part comprises a top ring assembled to a bottom ring, wherein the top ring includes an axial extension that abuts on a peripheral shoulder of the bottom ring, and wherein the top ring and the bottom ring each have a radial extension oriented towards an exterior in order to block movement of the outer middle part with slight play by mechanically assembling the top ring and the bottom ring to each other, wherein the outer middle part is sandwiched between the radial extension of the top ring and the radial extension of the bottom ring, and wherein the bottom ring is arranged to allow assembly of the back cover and the timepiece movement, wherein a sleeve is housed in a recess that is formed in the bottom ring of the inner middle part, wherein the sleeve housed in the recess provides a slight play between the inner middle part and the outer middle part and allows the outer middle part to be centered radially with respect to the inner middle part.

20. The watch according to claim 19, wherein the sleeve housed in the recess provides a slight radial play between the inner middle part and the outer middle part.

* * * * *